United States Patent [19]

Schaffner, II et al.

[11] Patent Number: 4,882,880

[45] Date of Patent: Nov. 28, 1989

[54] GANGING OF BUFFING WHEELS

[75] Inventors: Paul E. Schaffner, II, Pittsburgh; Gus J. Schaffner, III, Emsworth, both of Pa.

[73] Assignee: Schaffner Manufacturing Company, Inc., Emsworth, Pa.

[21] Appl. No.: 194,973

[22] Filed: May 17, 1988

[51] Int. Cl.[4] ..... B24D 13/04

[52] U.S. Cl. ..... 51/358; 51/168; 51/364; 300/21; 15/181

[58] Field of Search ..... 51/168, 206 R, 207, 51/293, 297, 330, 331, 332, 334, 336, 337, 356, 358, 364, 376; 15/181; 300/21

[56] References Cited

U.S. PATENT DOCUMENTS

| | | | |
|---|---|---|---|
| 2,027,863 | 1/1936 | Hall . | |
| 2,106,610 | 1/1938 | Kreilick et al. . | |
| 2,109,905 | 3/1938 | Lippitt . | |
| 2,110,494 | 3/1938 | Zimmerman . | |
| 2,244,582 | 6/1941 | Thompson . | |
| 2,539,844 | 1/1951 | Kingsbury . | |
| 2,582,506 | 1/1952 | Sax et al. . | |
| 2,594,812 | 4/1952 | Seelenfreund . | |
| 2,599,785 | 6/1952 | Sax . | |
| 2,805,530 | 9/1957 | Schaffner . | |
| 2,936,553 | 5/1960 | Jones . | |
| 3,191,208 | 6/1965 | Churchill . | |
| 3,289,234 | 12/1966 | Nelson | 15/181 X |
| 3,365,742 | 1/1968 | Schaffner . | |
| 3,541,093 | 6/1969 | McAleer . | |
| 3,548,435 | 12/1970 | Comber et al. . | |
| 3,727,353 | 4/1973 | Pixley . | |
| 3,733,754 | 5/1973 | Jeske . | |
| 3,839,763 | 10/1974 | Gould | 15/181 |
| 3,991,526 | 11/1976 | Frank et al. . | |
| 4,504,999 | 3/1985 | Pedrotte . | |
| 4,624,876 | 11/1986 | Nevin | 51/376 |

FOREIGN PATENT DOCUMENTS

| | | | |
|---|---|---|---|
| 710528 | 6/1965 | Canada | 51/364 |
| 127975 | 7/1985 | Japan | 51/334 |

*Primary Examiner*—Robert P. Olszewski
*Attorney, Agent, or Firm*—Hymen Diamond

[57] ABSTRACT

A ganged buffing wheel assembly driven by a shaft having keys. The assembly is formed of a plurality of axially coextensive cartridges keyed to the shaft. The cartridges are of light weight such that they can be manipulated by a workman without injury to himself. Each cartridge, typically, includes a sleeve of pressed paper with keyways of white pine on its inner surface and with buff sections separated by spacers of pressed paper on its outer surface. The keyways extend along the whole length of each sleeve so as to be engaged by the keys on the shaft along a large area of minimized stress. In assembling a cartridge, the buff sections are stacked on the sleeve supported on a spacer at one end which is secured to the shaft. The stack is compressed with adhesive between each buff section and the spacers on each side and in the compressed state secured to each other and to the sleeve and anchored through the spacer at the other end. The cartridges are of low cost so that they can be discarded when the buff sections are worn.

17 Claims, 4 Drawing Sheets

GANGING OF BUFFING WHEELS

BACKGROUND OF THE INVENTION

This invention relates to the art of buffing or finishing work. The words "buffing" and "finishing" are used in this application in the general sense including within their scope treatment of the work in which material is removed from the surface and coloring in which the work is endowed with a sheen without substantial removal of material. This invention has particular relationship to the treatment of objects which require buffing wheel assemblies of substantial length and it deals with ganged buffing wheel assemblies for buffing such objects. The individual buffing wheel which is ganged with other individual wheels to form a buffing wheel assembly will be referred to herein as a "buff section". Such an individual buffing wheel or buff section is described, together with a method of making it, in U.S. Pat. No. 2,805,530 to Paul E. Schaffner. The Schaffner buff sections are composed of a plurality of plies of buffing fabric layered on two drums across a gap between the drums. The layers are secured or pinched in the gap by a wire which is tightened about the bend in the layers. The layers are formed into an annulus by moving the drums towards each other axially and closing claws on a hub on the fabric radially inwardly of the wire. Schaffner's buff sections have a center plate which constitutes part of the hub. The current practice is to produce centerless buff sections. Centerless buff sections of one type usually, referred to as "standard", are secured by a ring of claws at the center. Centerless buff sections of another type, which are referred to as "light weight", are secured only by the wire at the center and usually sewn radially inwardly at the pinching wire to encase the wire.

A ganged buffing wheel assembly is described in U.S. Pat. No. 3,365,742 to James R. Schaffner. A ganged buffing wheel assembly, typically, includes a drive shaft from whose outer surface a plurality of circumferentially spaced keys extend axially. The ganged buffing wheel assembly is driven through these keys. It is desirable that the assembly have resilience so that the buffs penetrate into the work. This is called "mush buff" in the industry. To achieve "mush buff", each buff section is interposed between spacers. However, ganged buffing wheel assemblies in which the buffs are stacked abutting the adjacent buffs without spacers interposed are within the scope of equivalents of this invention.

In accordance with the teachings of the prior art, the ganged buff sections of the above-described buffing wheel assemblies are driven through the spacers. Each spacer is provided with keyways which are engaged by the keys on the shaft. As the shaft rotates, it rotates the buff sections in engagement with the work. The spacers are composed of hard plastic or aluminum. The spacers and the buff sections are assembled on the shaft in the users plant piece by piece. After the buff sections are worn, they are removed from the spacers and the spacers are reused with a new set of buff sections.

This prior art practice has the disadvantage that it has a high labor cost. The assembly of the spacers and the buff sections on the shaft piece by piece is time consuming. Additional time is consumed in securing the buff sections to the spacers so that the buff sections are driven through the spacers.

Another practice is to drive the buff sections through disks such as the disks of the buff sections shown in Schaffner '742. The disks are provided with keyways which are engaged by the keys on the shaft. A number of buff sections may be joined together as taught by Schaffner '742, but the number must be relatively small to limit the weight which must be handled by the personnel that fabricates the buffing wheel assembly. It is necessary to protect the personnel against injury from lifting and manipulating heavy loads, not only to limit the cost of worker's compensation insurance which must be paid to injured workers, but, also, because the Occupation Safety and Health Agency (OSHA) is in the process of preparing regulations that limit the weight that the personnel may be required to manipulate to about 45 pounds.

It is an object of this invention to overcome the disadvantages and drawbacks of the prior art and to provide a ganged buffing wheel assembly formed of lightweight buff-section parts which can be readily manipulated by personnel in fabricating a buffing wheel assembly in minimal time and at minimal labor cost and without injury to the personnel and which, when spent in use, can be readily disposed of by cogeneration. It is also an object of this invention to provide a method of endowing this assembly with compactness and rigidity in the fabrication thereof from the buff section parts.

SUMMARY OF THE INVENTION

In accordance with this invention, there is provided a buffing wheel assembly composed of a few compact cartridges of low weight. Each cartridge is composed of a sleeve or core of lightweight material having a plurality of axially extending circumferentially spaced keyways along its inner surface. The number of keyways is equal to the number of keys on the drive shaft and the keyways are dimensioned to be engaged in driving relationship by the keys on the shaft. The keyways are of light weight and they extend along substantially the whole axial length of the sleeve so that the driving force of the keys on the shaft is applied over a large area minimizing the stress exerted by the keys. A plurality of buff sections are mounted on the outer surface of the sleeve, each buff section interposed between a pair of spacers at the inner periphery of the buff section. The spacers are of light weight.

In making the cartridge, the keyways are secured by adhesive and pinned to the inner surface of the sleeve. An end spacer, which may be called the "lower end spacer", is secured to the outer surface by a fast setting adhesive, typically deposited as a bead on the inner surface of this spacer. Buff sections and spacers are then stacked alternately on this lower end spacer. This lower end spacer and the other spacers are provided on their lateral surfaces with slow setting adhesive. The buff sections may also be provided with slow setting adhesive near their inner peripheries; in particular beads of adhesive are provided at the radially inner joints between each buff section and the sleeve. At the opposite end of the sleeve, a spacer which may be called the "upper end spacer", having on its inner surface a bead of adhesive, which is also fast setting and sets in about one minute, is mounted. The stack is compressed by a press a distance of about one-half inch. The upper end spacer extends above the end of the sleeve by about one-half inch before the stack is compressed and after the stack is compressed, this upper end spacer is flush with the end of the sleeve. The end spacers are then secured by screws which penetrate the sleeve and engage the keyways and the slow setting adhesive is permitted to set. A compact rigid cartridge is thus produced.

Typically, the drive shaft is about 84 inches long. Typically, each cartridge is about 20 ½ inches long carrying about 13 buff sections. Only four cartridges need be mounted on a shaft to complete a buffing wheel assembly.

The buff sections on a cartridge may be all of one type, all polishing or all coloring, or they may be of two or more types, i.e., a number polishing and the remainder coloring. The buffing machines typically include facilities for shifting the buffing wheel assembly axially so that with a buffing wheel assembly having buff sections of both types, a polishing operation may be followed by a coloring operation without mounting separate assemblies. The buff sections may be of the "standard" type with claws at the inner periphery or of the "light-weight" type with the pinching wire only at the inner periphery. The sleeve and spacers are typically composed of pressed paper, i.e., cardboard; the keyways are composed of pine wood. A cartridge 20½ inches long with 13 buff sections weighs about 44 pounds. When the buff sections become worn, the cartridges can be discarded. No problem is involved from accumulating waste. The worn cartridge can be burned in a cogeneration plant; i.e., the burning may serve to generate electrical power.

BRIEF DESCRIPTION OF THE DRAWINGS

For a better understanding of this invention, both as to its organization and as to its method operation, together with additional objects and advantages thereof, reference is made to the following description taken in connection with the accompanying drawings, in which.

DETAILED DESCRIPTION OF EMBODIMENT

Figure 1:
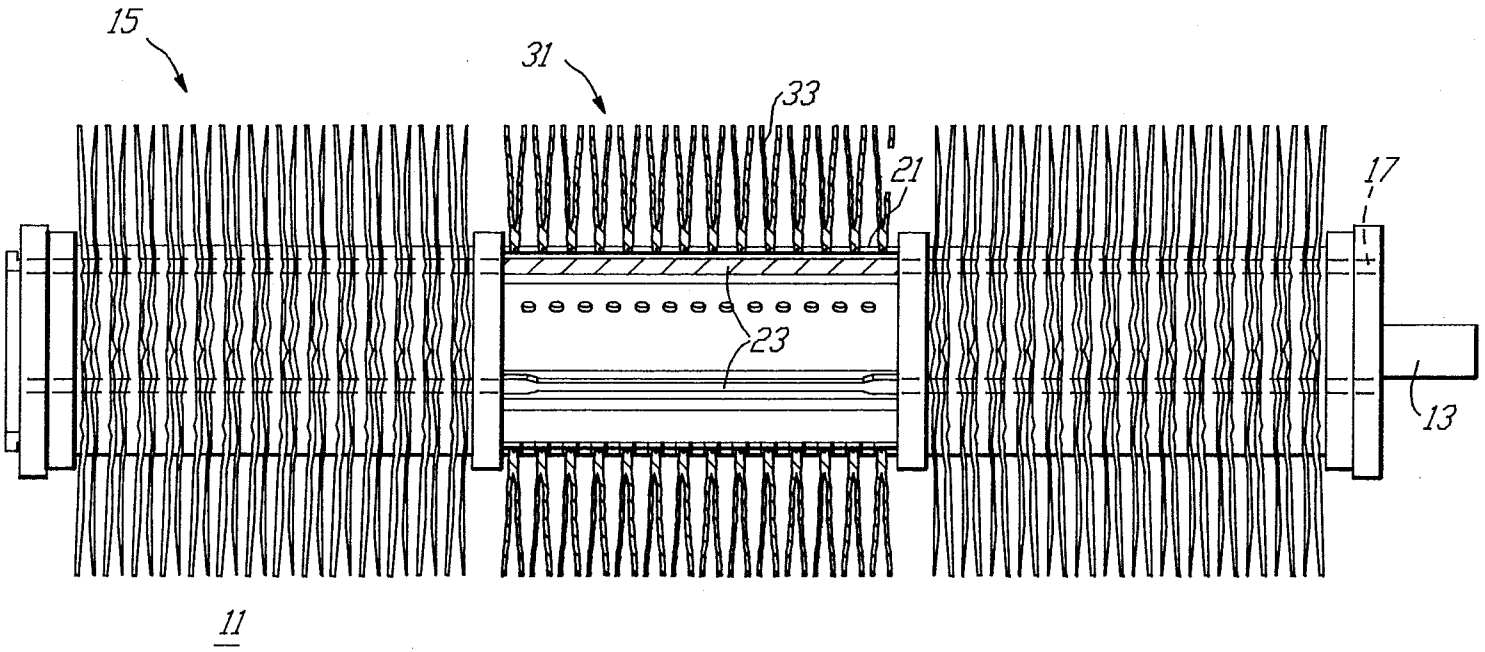
FIG. 1 is a view in side elevation and partly in section showing a ganged buffing wheel assembly in accordance with this invention.
Figure 3:
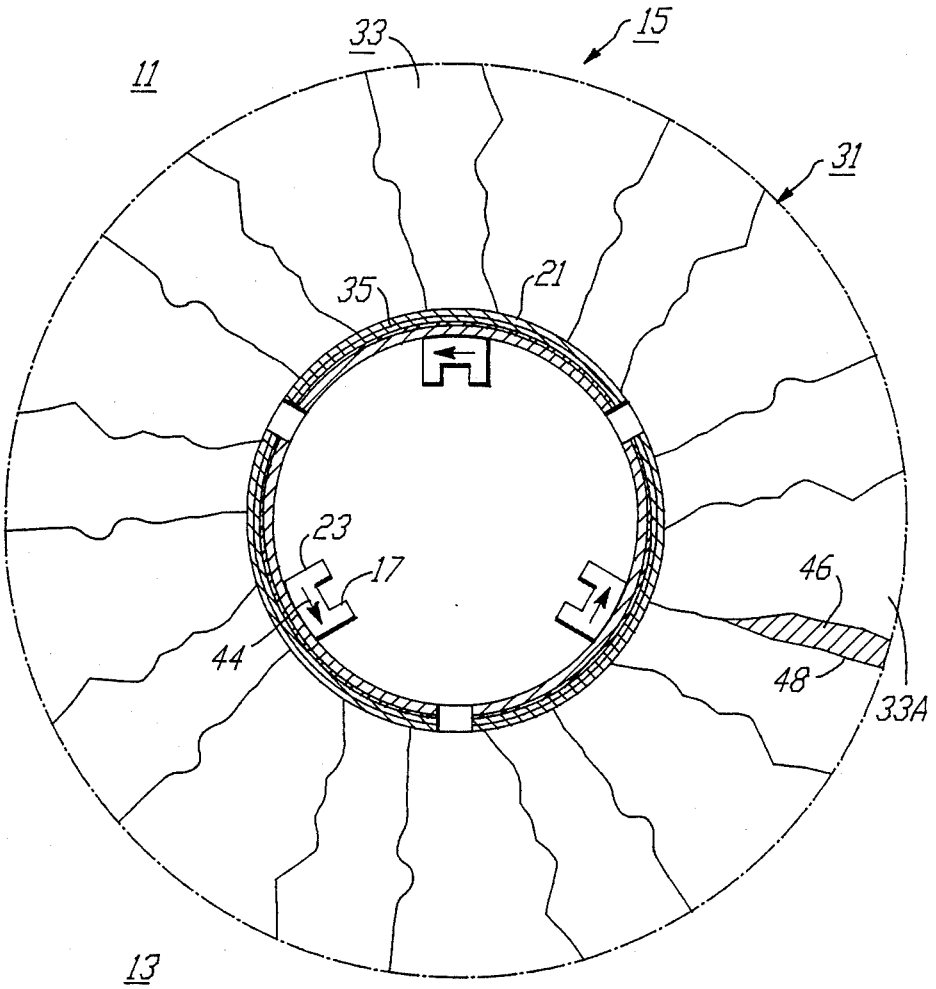
FIG. 3 is a view in transverse section taken along line III-III of FIG. 2.

FIGS. 1 and 3 show a ganged buffing wheel assembly 11 including a drive shaft 13 on which are mounted a plurality of cartridges 15 of low weight. The shaft 13 has a plurality of keys 17 extending axially and spaced circumferentially, typically by 120°, through which the cartridges 15 are driven. Typically, the drive shaft 13 may be 84 inches long.

Each cartridge 15 (FIG. 2) includes a sleeve or core 21, typically composed of cardboard. Along the inner surface of the core, there are a plurality of keyways 23 extending axially and spaced circumferentially, typically by 120°. The keyways 23 are composed of wood, typically light pine, and each extends substantially along the whole axial length of the sleeve 21 as shown.

Cardboard and light pine inherently have substantially lower thermal conductivity than metal such as steel. The keyways are secured to the inner surface of the sleeve 21 by adhesive and also by pins or screws 24. The keyways 23 are engaged in driving relationship by the keys 17 on the shaft 13. The width of the keyways 23 is expanded at the ends 25 to facilitate mounting of each cartridge 15 on the shaft 13 in engagement with the keys 17.

Figure 2:
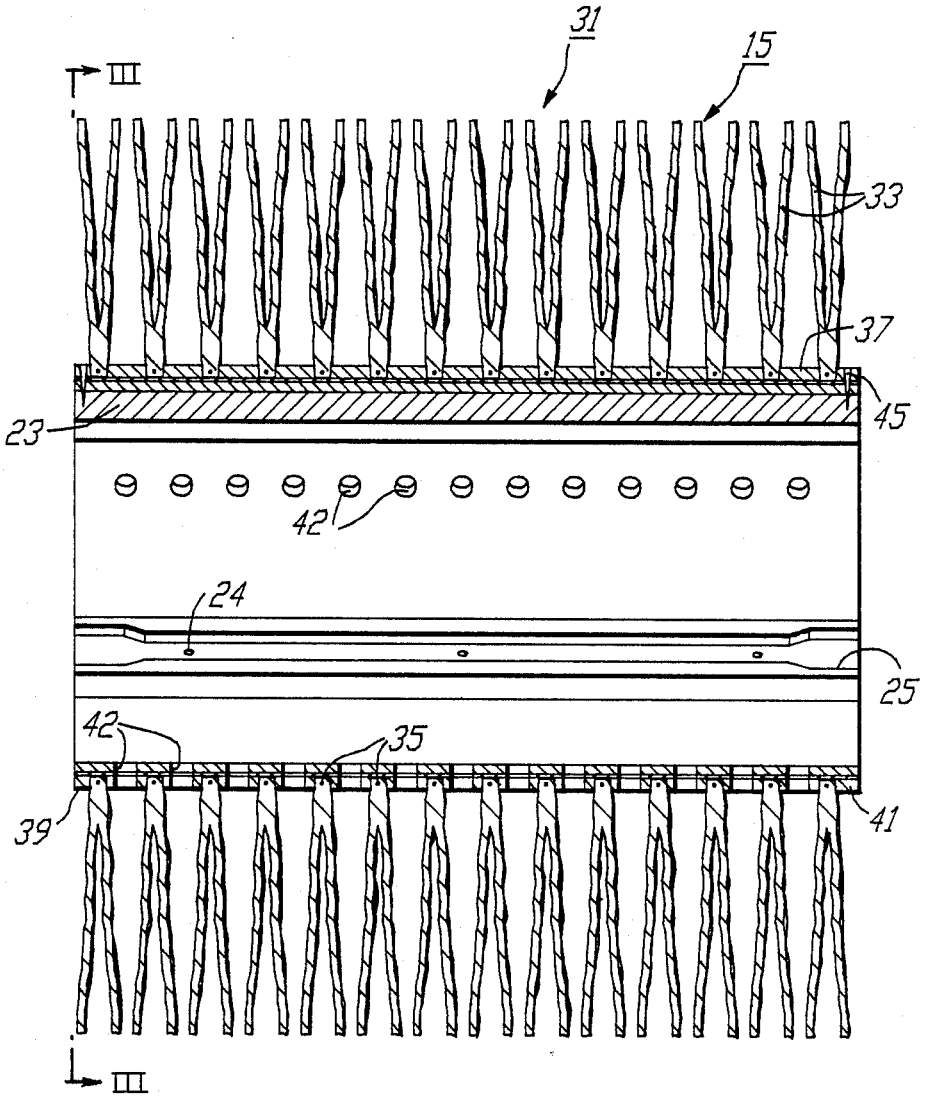
FIG. 2 is a view in longitudinal section, with the buff sections not sectioned, of a cartridge, in accordance with this invention.

A plurality of buff sections 31 are mounted on the outer surface of the sleeve 21. Each buff section 31 is of the "lightweight" type with its fabrics 33 secured or pinched by a wire ring 35 as disclosed in FIGS. 2 through 6 of Schaffner '530, except that the claws are omitted. The buff sections 31 are separated and secured together and secured to the sleeve 21 by intermediate spacers 37 and end spacers 39 and 41 (FIG. 2). Each buff section 31 is interposed at its inner rim between a pair of spacers 37 or, near the ends, between a spacer 37 and the lower end spacer 39, or between a spacer 37 and the upper end spacer 41. The sleeve and the spacers 37 are penetrated by air holes 42 for cooling the cartridge 31 while it is in use. On their ends, the keyways 23 are provided with arrows 44 to indicate the direction in which the cartridges should rotate. The directions should be such that the edge 46 of the buff tail 48 (the outer layer of the fabrice 33A) trails the outer layer 33A.

Figure 4:
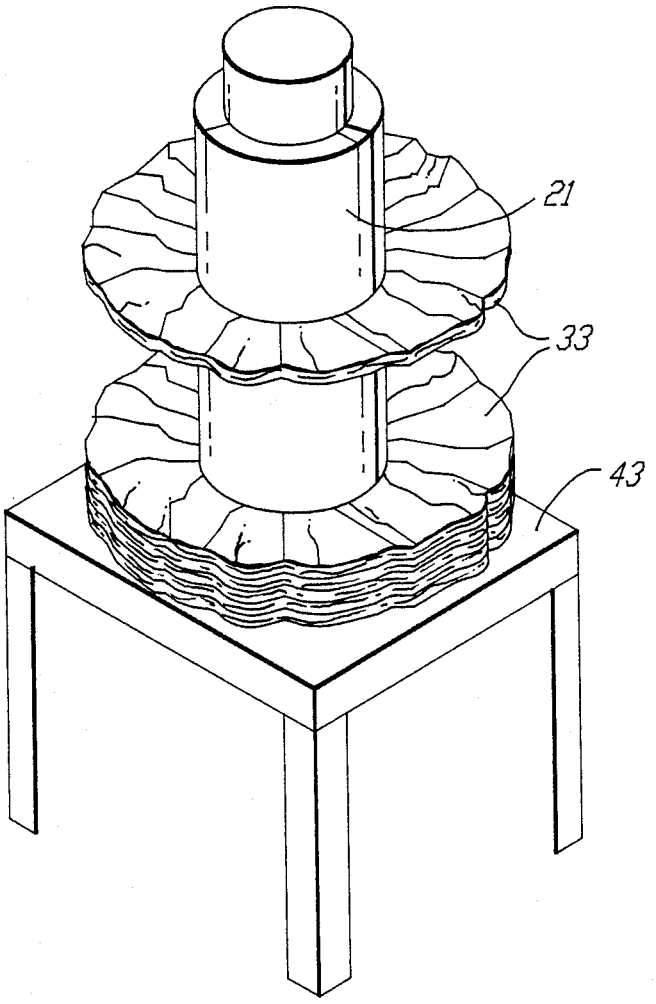
FIG. 4 is a copy of a photograph showing the manner in which a cartridge, in accordance with this invention, is assembled.

The manner in which the buff sections 31 and the spacers 37, 39, 41 are mounted, of the sleeve, will be described with reference to FIG. 4. At the start, the lower end spacer 39 is provided with a bead of fast-setting adhesive which is engaged with an end of the sleeve 21. The sleeve with the end spacer 39 secured to it is placed on a horizontal platform 43 (FIG. 4) with the end spacer 39 at the base. The upper lateral face of the end spacer 39 is beaded with a slow setting adhesive and buff sections and spacers 37 are stacked alternately on the end spacer. Each spacer 37 is beaded with slow setting adhesive on both lateral surfaces. Each buff section may also be beaded after it is stacked at the radially inner peripheral joint between the buff section and the sleeve. Where the buff sections are abutted without spacers, the buff sections are secured to the sleeve by such beads at the radially inner joints between each buff section and the sleeve. The stacking is continued until the last of the buffing sections is just below the top of the sleeve 21. The upper end spacer 41, beaded laterally and on its inner surface with an adhesive which sets in about one minute (fast setting), is then mounted on the sleeve 21 extending about one-half inch above the upper rim of the sleeve. The stack is then compressed by a press typically driven by a hand crank until the upper lateral surface of the spacer 41 is flush with the upper end of sleeve 21. The end spacers are secured to the sleeve by screws 45 which engage the keyways 23. The screws are inserted before the slow setting adhesive sets and maintain the stack rigid until this adhesive sets. A compact cartridge, with the buff sections rigidly mounted, is thus provided.

Typically, there are about 13 buff sections 31 on each cartridge. The buff sections may be all of one type, for example, for polishing or for coloring. They may also be of two types, for example, seven for polishing and six for coloring, so that the work may receive complete treatment in a single set-up. The spacers 37, 39, 41 are composed of cardboard. Typically, the spacers 37 are one-inch long. The end spacers 39 and 41 may be one-half inch long where the buff sections are all of one type so that the spacing between the buff sections is uniform over the whole length of a ganged buffing wheel assembly. Where the buff sections are of two types, the end spacers 39 and 41 are typically 1¼ inches long so that there is a gap of 2½ inches between adjacent cartridges.

This spacing is desirable to preclude the possibility that when the work is shifted from the polishing buff sections to the coloring buff sections on a cartridge, it will not overlap the polishing sections on the adjacent cartridge.

EXAMPLES

I

Standard buff sections 31 with clinch ring:

| | |
|---|---|
| 7 sections 24 ×9 centerless 16 ply 2S GXL for polishing<br>6 sections 24 × 9 centerless 14 ply 2S 60/60 for coloring | spun and trimmed to produce a circular outer periphery |

1½20½" Sleeve 21,
3½20½" Wooden (pine) keyways 120° apart.
14 Spacers, 2 (1¼") spacer both ends.
12 (1") spacer between each buff.

a. Liquid nail and pin 3 times each keyway.
b. Hot glue first end spacer 39.
c. Insert screws in the end spacers 39.
d. Liquid nail each buff section 21 and each spacer 37, making sure to turn each buff section one-quarter turn and keeping all tails 48 in proper direction.
e. Compress total cartridge one-half inch until end spacer 41 is flush with sleeve 21, hot glue second end spacer 41.
f. Insert screws in the end spacer 41.
g. Remove cartridge from press and allow slow setting adhesive to set.

| | |
|---|---|
| Total buff | 6.517" |
| Total spacer | 14.5" |
| Total cartridge | 21" |

h. Drill 3/8" air holes in each spacer between each keyway 23.
i. Place arrows 44 on both ends of each keyway 23 showing direction of rotation.

II

Lightweight buff sections pinched with 11 gauge 1006 soft annealed wire 25.79'lb. Four rows concentric or four rows spiral sewn to encase the wire 35.

| | | |
|---|---|---|
| 7 sections 24 ×9 centerless 16 ply 2S GX1 for polishing<br>6 sections 24 × 9 14 ply 2S 60/60 for coloring | | spun and trimmed |
| 3.71875" | Buff section compressed | |
| 2.7989052" | Buff section compressed | |
| 6.5176552" | Total buff section | |

1- 20½" sleeve 21,
3 - 20½" wooden keyway 120° apart,
14 - Spacers, 2 (1¼") spacer both ends, 12 (1") spacers between each buff.

a. Liquid nail and pin three times each keyway.
b. Hot glue first end spacer 39.
c. Insert screws in the end spacer 39.
d. Liquid nail each buff section and each spacer, making sure to turn each buff section one-quarter turn and keeping all tails in proper direction.
e. Compress total cartridge one-half inch until end spacer 41 is flush with sleeve, hot glue second end spacer.
f. Insert screws in the end spacer 41.

| | |
|---|---|
| Total buff | 6.517" |
| Total spacer | 14.5" |
| Total cartridge | 21" |

g. Remove cartridge from press and allow slow-setting adhesive to set.
h. Drill ⅜" air holes in each spacer between each keyway.
i. Place arrows on both ends of each keyway showing direction of rotation.

III

Buff sections 31 pinched using 11 gauge 1006 soft annealed wire 25.79' lb. Four rows concentric sewn, four rows spiral sewn.

| | |
|---|---|
| 7 sections 24 × 9 centerless 16 ply 2S 86/80 for polishing<br>6 sections 24 × 9 centerless 14 ply 2S 50/50 for coloring | spun and trimmed |

1 - 20½" sleeve 21,
3 - 20½" wooden keyway 120° apart,
14 - spacers 2 (1¼) spacer both ends, 12 (1") spacers between each buff.

a. Liquid nail and pin three times each keyway.
b. Hot glue first end spacer 39.
c. Insert screws in an end spacer 39.
d. Liquid nail each buff and each spacer making sure to turn each buff section one-quarter turn and keeping all tails in proper direction.
e. Compress total cartridge one-half inch until end spacer 41 is flush with sleeve, hot glue second end spacer.
f. Insert screws in end spacer 41.
g. Remove cartridge from press and allow slow-setting adhesive to set.
h. Drill ⅜" air holes in each spacer between each keyway.
i. Place arrows on both ends of each keyway showing direction of rotation.

IV

Buff sections light-weight pinched using 11 gauge 1006 soft annealed wire 25.79'/lg. Four rows concentric, four rows spiral sewn.

12 sections centerless 16 ply 2S Green Extra Life (GXL), spun and trimmed.
1 - 20½" sleeve 21,
3 - 20½" wooden keyways 120° apart,
13 - spacers 2 (5/8") spacers both ends, 11 (1¼") spacers between each buff.

a. Liquid nail and pin three times each keyway.
b. Hot glue first end spacer 39.
c. Insert screws in the end spacer 39.
d. Liquid nail each buff and each spacer making sure to turn each buff one-quarter turn and keeping all tails in proper direction.
e. Compress total cartridge one-half inch until end spacer 41 is flush with sleeve, hot glue second end spacer.

f. Insert screws in end spacer 41.
g. Remove cartridge from press and allow slow setting adhesive to set.
h. Drill ⅜" air holes in each spacer between each keyway.
i. Place arrows on both ends of each keyway showing direction of rotation.

Buff sections light-weight pinched using 0.057 diameter wire from Randall, driven by friction through protrusions on the drive shaft instead of keys on the drive shaft and keyways in the sleeve.

8 sections 10×5 centerless 4 ply 1S White T Sati abrasive fabric, trimmed and faced,
1 8" sleeve
2 paper cardboard spacers
a. Hot melt first section of buff section to sleeve.
b. Turn every other tail in opposite direction, hot melt each buff section to sleeve.
c. Insert screws in the end spacer 39.
d. Hand compress slightly.
e. Hot melt two paper cardboard spacers to both ends.
f. Insert screws in end spacer 41.
g. Face on hand lathe with buff rake then 60 grit abrasive until even and fuzzy.

While preferred embodiments of this invention have been disclosed herein, many modifications of this invention are feasible. For example, as disclosed above, the drive shaft 13 has keys and the sleeves 21 have keyways 23. The driving mechanism may be reversed. The sleeves can have keys and the drive shaft keyways. The objective of providing a light-weight cartridge may also be achieved by providing a hollow sleeve or core of cardboard with end caps typically of metal or end inserts having arbor holes in the center. The end caps and sleeves are held together as a rigid unit by longitudinal strips typically of metal which extend axially within the sleeve near its periphery. Each strip is bent over at its ends to form tabs which are riveted or welded to the end caps or secured by an adhesive particularly if the end caps and sleeves are not metal. Buff sections are stacked and secured to the sleeve to form a cartridge as described above. The cartridges are stacked on a shaft on which they are a slip fit at the arbor holes and are driven by the shaft through flanges which engage the end caps of the end cartridge. This invention is not to be restricted except insofar as is necessitated by the spirit of the prior art.

We claim:

1. A ganged buffing wheel assembly including a shaft, a plurality of driving components mounted spaced circumferentially on said shaft, and being continuous and extending substantially along the entire active length of said shaft, each of said driving components consisting of one of the set of components consisting of a key and a keyway, a plurality of elongated sleeves mounted abutted coaxially and coextensively on said shaft without interconnecting couplings between said abutted sleeves, each said sleeve having mounted on the inner surface thereof a plurality of driven components, each of said driven components consisting of the other of said set of components, said sleeves being oriented on said shaft so that said driven components are coextensive and are in engagement with said drive components on said shaft so that said abutted sleeves may be driven together, and a plurality of buff sections mounted on, and connected to, each said sleeve to be driven when each said sleeve is driven by said shaft, said driven components being continuous and mounted along substantially the entire axial length of said each said sleeve so that the stress exerted by said driven components on said sleeve is minimized, said sleeve and said driven components being composed of light-weight material having low resistance to stress and substantially lower thermal conductivity than metal such as steel.

2. The assembly of claim 1 wherein in each package including the sleeve, the driven components and the buff sections of said sleeve, each buff section is of the "light-weight" type with a pinching wire only at the inner periphery thereof, so that said each package can be manipulated by a workman without injury to himself.

3. The assembly of claim 1 wherein each buff section on the sleeve is interposed between spacers.

4. The assembly of claim 3 wherein the package including the sleeve, the driven components and the buff sections and spacers, is a tightly compressed assembly in which the buff sections are connected to the sleeve so as to be driven in buffing contact with work when the sleeve is driven through at least one of the plurality of said driven components.

5. The assembly of claim 4 wherein the buff sections are connected to the sleeve so as to be driven in buffing contact with work when the sleeve is driven through the driven components mounted on the sleeve.

6. A light-weight cartridge for a ganged buffing wheel assembly including a light-weight sleeve, a plurality of light-weight components through which said sleeve is to be driven connected to the inner surface of said sleeve, each of said components being one of the set of components consisting of a key and a keyway, and a plurality of buffing sections mounted on the outer surface of said sleeve and connected to said sleeve to be driven in buffing contact with work when said sleeve is driven through said components, said components extending continuously along substantially the whole length of the inner surface of said sleeve so that said cartridge can be mounted on a shaft having mounted thereon driving components consisting of the other of said set of components coextensively with at least one other like abutting cartridge with their driven components coextensive without interconnecting couplings between said abutted sleeves, and with the driving components in engagement with said coextensive driven components, said sleeve and said driven components being composed of light-weight material having low resistance to stress and substantially lower thermal conductivity than metal such as steel.

7. The cartridge of claim 6 wherein each buff section is of "light-weight" type with a pinching wire only at the inner periphery thereof so that the weight of said cartridge is less than a predetermined magnitude permitting the package to be manipulated by a workman without injury to himself.

8. The cartridge of claim 6 wherein each buff section is interposed between adjacent spacers, at least one of the spacers of the array of buff sections being secured to the sleeve and the other spacers being secured to adjacent buff sections near the inner peripheries of said adjacent buff sections.

9. The cartridge of claim 8 wherein the spacers are also composed of light-weight material and each buff section is of the "light-weight" type with a pinching wire only at the inner periphery thereof so that the weight of the cartridge is below a predetermined magnitude such that the cartridge can be readily manipulated by a workman without damage to himself.

10. The cartridge of claim 6 wherein the buff sections are mounted on the sleeve in a tightly compressed stack with spacers with each buff section interposed between adjacent spacers and with the end spacers of the stack secured to the sleeve at their inner surfaces and each buff section secured to said adjacent spacers near the inner periphery of said each buff section.

11. The method of producing a cartridge for a ganged buffing wheel assembly with a sleeve, buff sections, and spacers, and driving components for the sleeve including one component of the set of components consisting of a key and a keyway; the said method including:

(a) securing to the inner surface of said sleeve circumferentially spaced, a plurality of said one component;
(b) securing a spacer near one end of the outer surface of said sleeve;
(c) stacking on said sleeve alternately sleeves and spacers;
(d) prior to the stacking of each stacked spacer except the spacer on the end opposite to said one end of said sleeve, depositing on its lateral surfaces a bead of slow-setting adhesive;
(e) compressing said stack, and
(f) thereafter securing the spacer at end of said stack opposite to said one end of said sleeve to said sleeve.

12. The method of claim 11 wherein the spacers at the ends of the sleeve are secured to the sleeve by an adhesive deposited on the inner surface of said spacers, the adhesive deposited on the surface of the spacer at both ends of the sleeve being quick setting adhesive.

13. The method of claim 11 wherein the spacers at the ends of the sleeve are secured to the sleeves by screws which engage the one components.

14. A ganged buffing-wheel assembly including a shaft, a plurality of driving components mounted spaced circumferentially on said shaft, and being continuous and extending substantially along the entire active axial length of said shaft, each of said components consisting of one of the set of components consisting of a key and a keyway, a plurality of elongated sleeves mounted abutted coaxially and coextensively on said shaft without interconnecting couplings between said abutted sleeves, each said sleeve having mounted on the inner surface thereof a plurality of driven components, consisting of the other of said set of components, said sleeves being oriented on said shaft so that said driven components are coextensive and are in engagement with said driving components on said shaft so that said abutted sleeves may be driven together, and a plurality of buff sections mounted on, and connected to, each said sleeve to be driven when each said sleeve is driven by said shaft, said driven components being continuous and mounted along substantially the entire axial length of said each said sleeve so that the stress exerted by said driven components on said sleeve is minimized, each said buff section being interposed between spacers, and each sleeve, the driven component mounted on the inner surface of said each sleeve, and the spacers are all composed of a material having substantially lower conductivity than metal such as steel and also being of low weight and accompanying low resistance to stress so that the package including these parts has a weight lower than a predetermined magnitude such that said package may be manipulated readily by a workman without injury to himself.

15. The ganged buffing wheel assembly of claim 14 wherein each buff section is of the "light-weight" type with a pinching wire only at the inner periphery thereof.

16. A ganged buffing wheel assembly including a shaft, a plurality of driving components mounted spaced circumferentially on said shaft and being continuous and extending substantially along the entire active axial length of said shaft, each of said driving components consisting of one of the set of components consisting of a key and a keyway, a plurality of elongated sleeves mounted abutted coaxially and coextensively on said shaft without interconnecting couplings between said abutted sleeves, each said sleeve having mounted on the inner surface thereof a plurality of driven components, each of said driven components consisting of the other of said set of components, said sleeves being oriented on said shaft so that said driven components on said sleeves are coextensive and are in engagement with said driving components on said shaft so that said abutted sleeves may be driven together, and a plurality of buff sections mounted on, and connected to, each said sleeve to be driven when said each said sleeve is driven by said shaft, said driven components being continuous and mounted along substantially the entire axial length of said each said sleeve so that the stress exerted by said driven components on said sleeve is minimized, said sleeve and said driven components being composed of light-weight material having low resistance to stress and substantially lower thermal conductivity than metal such as steel.

17. A ganged buffing wheel assembly including a shaft, driving means on said shaft, said driving means being continuous and extending substantially along the entire active axial length of said shaft, said driving means consisting of one of a set consisting of key means and keyway means, a plurality of sleeves mounted abutted coaxially and coextensively on said shaft, without intervening couplings between said abutted sleeves, each said sleeve having mounted on the inner surface thereof driven means, said driven means consisting of the other of said set, said sleeves being oriented on said shaft so that said driven means on said sleeves is coextensive with and is in engagement with said driving means on said shaft so that said abutted sleeves may be driven together, and a plurality of buff sections mounted on, and connected to, each said sleeve to be driven when said each said sleeve is driven by said shaft, said driven components being continuous and mounted along substantially the entire axial length of said each said sleeve so that the stress exerted by said driven components on said sleeve is minimized, said sleeve and said driven components being composed of light-weight material having low resistance to stress and substantially lower thermal conductivity than metal such as steel.

* * * * *

UNITED STATES PATENT AND TRADEMARK OFFICE

CERTIFICATE OF CORRECTION

PATENT NO. : 4,882,880

DATED : November 28, 1989

INVENTOR(S) : Schaffner, II et al

It is certified that error appears in the above-identified patent and that said Letters Patent is hereby corrected as shown below:

Column 10, lines 54, 56-57, and 58 "driven components" should be --driven means--.

Signed and Sealed this

Eleventh Day of June, 1991

*Attest:*

HARRY F. MANBECK, JR.

*Attesting Officer*

*Commissioner of Patents and Trademarks*